US005613672A

United States Patent [19]

Tanaka et al.

[11] Patent Number: 5,613,672

[45] Date of Patent: Mar. 25, 1997

[54] PAPER RETAINER

[75] Inventors: Masayuki Tanaka; Yuji Ohashi, both of Kyoto; Masashi Sugimoto, Hyogo, all of Japan

[73] Assignee: Omron Corporation, Kyoto, Japan

[21] Appl. No.: 521,075

[22] Filed: Aug. 29, 1995

[30] Foreign Application Priority Data

Sep. 3, 1994 [JP] Japan ..... 6-234390

[51] Int. Cl.[6] ..... B65H 1/00

[52] U.S. Cl. ..... 271/162; 271/171; 271/207; 271/223; 211/50; 211/181

[58] Field of Search ..... 271/145, 162, 271/163, 171, 207, 223; 211/50, 126, 181; 400/625

[56] References Cited

U.S. PATENT DOCUMENTS 4,220,323 9/1980 Smith ..... 271/207
4,558,858 12/1985 Runzi ..... 271/171
4,565,360 1/1986 Runzi ..... 271/171

FOREIGN PATENT DOCUMENTS 60-40335 3/1985 Japan ..... 271/145
0231738 9/1989 Japan ..... 271/171

*Primary Examiner*—H. Grant Skaggs
*Attorney, Agent, or Firm*—Fish & Richardson P.C.

[57] ABSTRACT

A paper retainer assembly for attachment to a feed-in mechanism at a paper inlet or a feed-out mechanism at a paper outlet, includes a flexible, linear paper retainer, such as a metal or plastic wire. The paper retainer is operable to be extended to an extended position for use and retracted to a retracted position when not in use. The assembly also includes a locking mechanism operable to maintain the paper retainer in the extended position.

25 Claims, 5 Drawing Sheets

PAPER RETAINER

BACKGROUND OF THE INVENTION

The invention concerns a device for retaining paper (primarily, a single sheet of paper). The device is attached to either the paper outlet of a feed-out mechanism or the paper inlet of a feed-in mechanism of a scanner, fax machine, word processor, printer, or the like.

FIGS. 10 and 11 show examples of prior art paper retainers that are in common use. The paper retainer shown in FIG. 10 has a flat support 33 to hold the paper. Support 33 is attached to paper outlet 32 on main body 31, of which rollers 30 are essential constituents of the feed-out mechanism. Support 33 is positioned at a fixed angle with respect to the horizontal surface of the main body. On the end of support 33 opposite main body 31 is a narrower flat support extension 34, which rotates on hinges 35*a* and 35*b* in the directions indicated by arrows R. Support extension 34 is mounted so that it can be extended upward at an angle for use, as shown by the solid lines in FIG. 10, or folded down onto main support 33 when not in use, as shown by the dotted lines.

The paper retainer illustrated in FIG. 11 also has a flat main support 33 to hold the paper. Support 33 is attached to paper outlet 32 on main body 31, of which rollers 30 are essential constituents of the feed-out mechanism. Support 33 is positioned at a fixed angle with respect to the horizontal surface of the body. In the center of fixed support 33 is a slot 36, in which a narrower flat support extension 34 is engaged in such a way that it can freely slide in the directions indicated by arrows A. Support extension 34 may be extended out from main support 33 for use, as illustrated in FIG. 11, or may be retracted when not in use.

With each of the existing paper retainers described above, support extension 34 can be extended from support 33 when in use. This permits extension of the paper retainer to a length comparable to the length of the paper to be held, which permits the paper retainer to handle paper of various lengths. When the device is not in use, support extension 34 can be accommodated on or within component 33. This allows the entire device to be stored in a compact form, which permits the depth of the scanner or other device to which the paper retainer is attached to be reduced.

SUMMARY OF THE INVENTION

The invention provides a paper retainer that, relative to the paper retainers described above, has fewer parts, is easier to manufacture, and can be produced at a substantially lower cost. The paper retainer is extremely compact, which permits the size of the device to which it is attached to be reduced to a greater degree than the size of devices to which the previously described paper retainers are attached.

A paper retainer assembly according to the invention includes a paper retainer, a case for holding the paper retainer in a retracted position, and a locking mechanism for holding the paper retainer in an extended position. The paper retainer includes a wire that is formed by a wire-bending process that renders it elastically deformable and has, on its end, at least one protrusion. The paper retainer may be completely retracted within the case or extended so as to protrude from the case. When the paper retainer is extended from the case, the locking mechanism immobilizes the paper retainer to maintain it in the extended position. The elasticity of the paper retainer causes the paper retainer to return toward its retracted position when not held in place by the locking mechanism.

Typically, the locking mechanism comprises grooves on the edge of the case. These grooves engage with portions of the paper retainer when it is extended fully from the—case, and its inner ends have been rotated upward until it has attained a given angle with respect to the surface of the feed-in or feed-out mechanism to which the paper retainer assembly is attached. Preferably, the locking mechanism comprises multiple pairs of grooves, each of which permits the extended paper retainer to be positioned at a different angle with respect to the feed-in or feed-out mechanism to which the paper retainer assembly is attached.

The invention uses a single paper retainer that is formed by a wire-bending process that renders it capable of elastic deformation. The elasticity of the paper retainer permits the paper retainer to be drawn out of the case or automatically returned thereto. When drawn out, the paper retainer can be made sufficiently long to accommodate the size of paper being used. When retracted, the paper retainer requires little storage space, and can be contained in a compact chamber. Because the paper retainer is sufficiently elastic to automatically return to its retracted state within the case, the simple act of releasing the locking mechanism when the paper retainer is extended will cause it to return, thus making it extremely simple to operate.

As described above, the mechanism used to immobilize the paper retainer in its extended state comprises grooves on the edge of the case which elastically engage with portions of the paper retainer when it is fully extended from the case and its inner ends have been rotated upward until it has attained a given angle. The use of this mechanism simplifies both the overall configuration of the device and the operation of the catch and release used to extend or retract the paper retainer.

As also described above, the paper retainer is elastically engaged when extended from the case, and may be positioned at a number of angles. This permits the paper to be held securely regardless of the number of sheets or their thickness. The configuration which allows the angle to be changed is quite simple, as is the operation required to change it.

DESCRIPTION OF THE PREFERRED EMBODIMENTS

Figure 1:
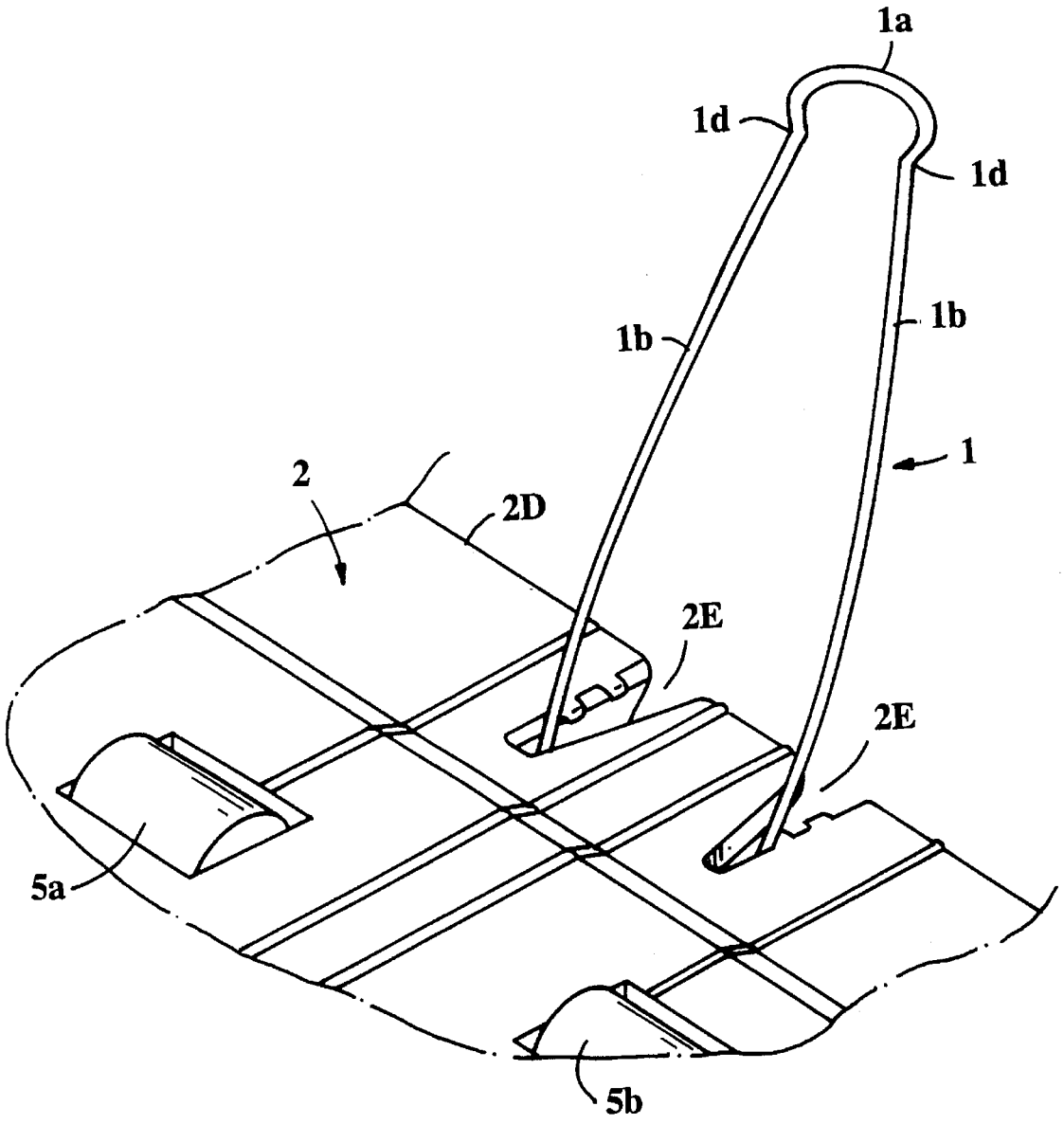
FIG. 1 is a perspective view of a paper retainer assembly according to the invention with the paper retainer in an extended position.
Figure 2:
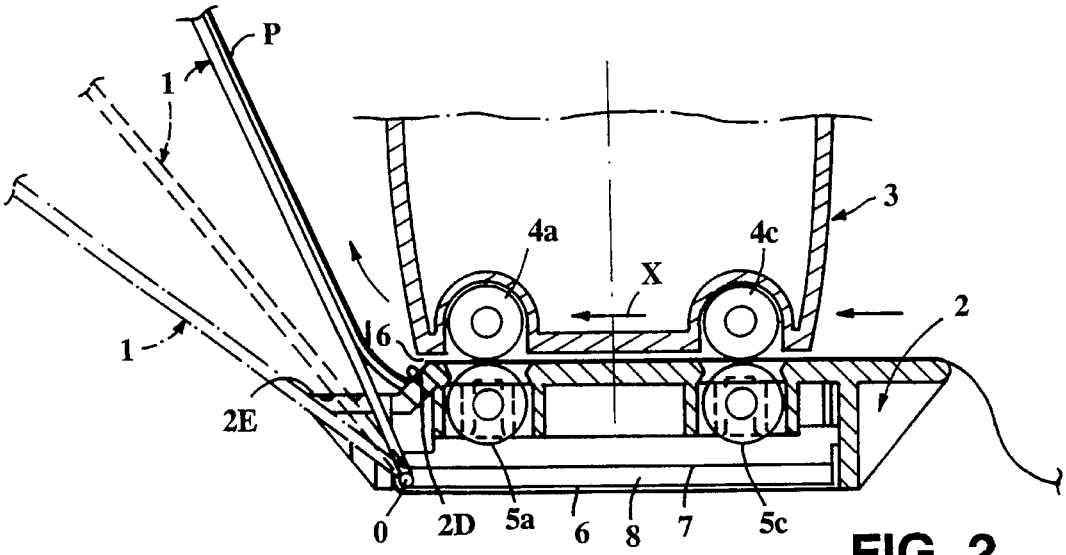
FIG. 2 is a cross section of a device including the paper retainer assembly of FIG. 1.
Figure 4:
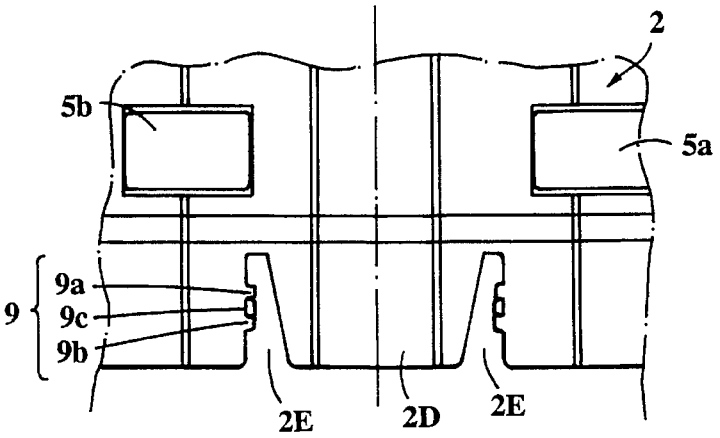
FIG. 4 is a top view of a portion of a case of the paper retainer assembly of FIG. 1.
Figure 6:
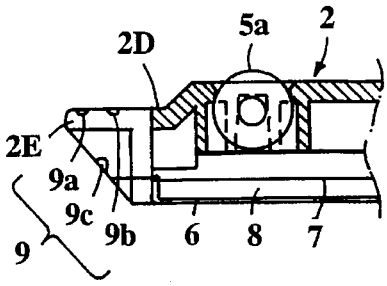
FIG. 6 is a cross section taken along line 6—6 in FIG. 5.

Referring to FIGS. 1 and 2, a paper retainer assembly includes a paper retainer 1 and a case 2. Case 2 is fixed to the bottom of a device 3 (e.g., a fax machine). (For ease of illustration, device 3 is not illustrated in FIG. 1). Rollers 4*a*–4*d* (only rollers 4*a* and 4*c* are illustrated in FIG. 2) are positioned within indentations on the bottom of device 3 and are driven to feed the paper out of the device. Auxiliary rollers 5*a*–5*d* (only rollers 5*a* and 5*b* are illustrated in FIG. 1, only rollers 5*a* and 5*c* are illustrated in FIG. 2) are axially supported in the top of case 2 in positions corresponding to rollers 4*a*–4*d*. While rollers 4*a*–4*d* are driven, rollers 5*a*–5*d* are free to rotate. Together, rollers 4*a*–4*d* and 5*a*–5*d* comprise a paper feed mechanism that feeds paper P out of a paper outlet 16 between the device 3 and the top of the case 2.

Figure 3:
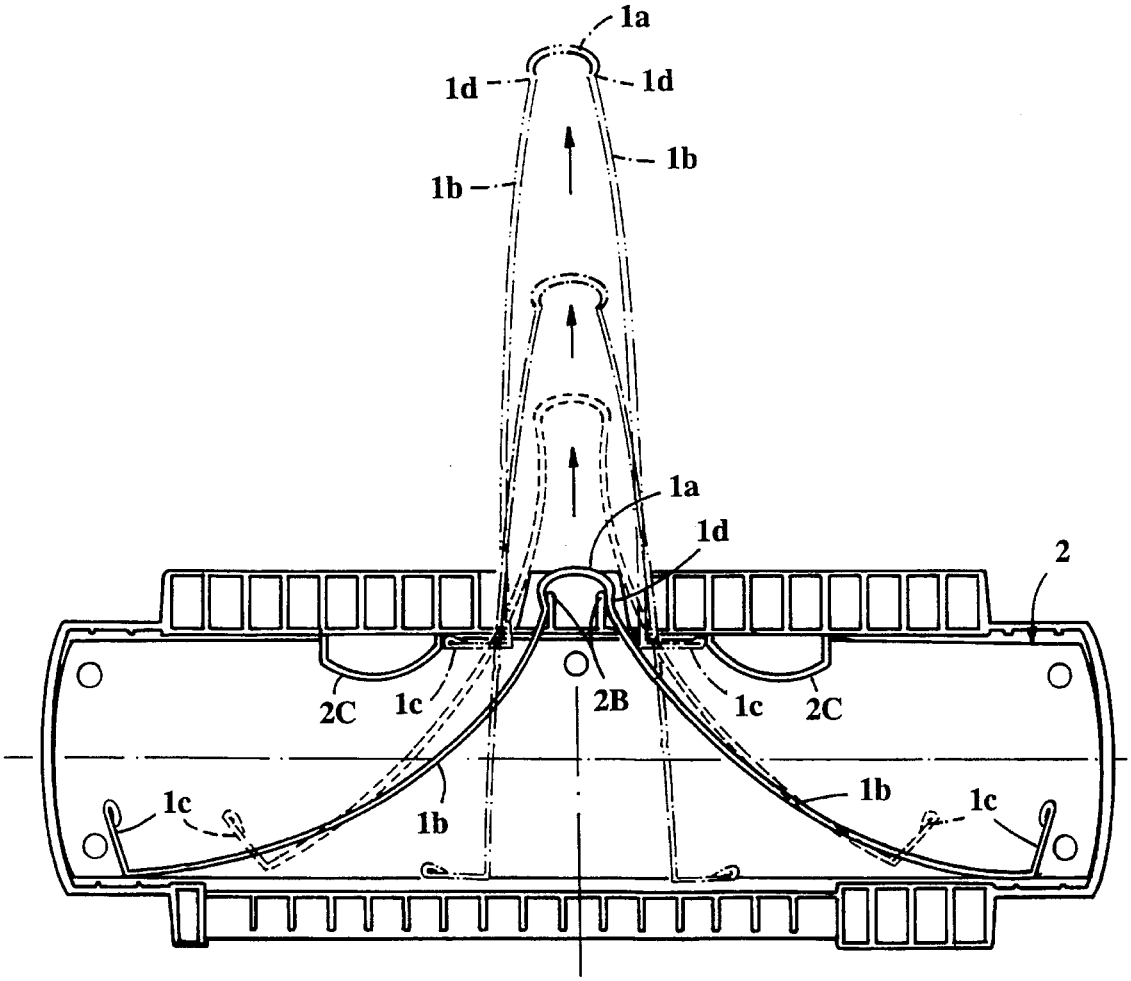
FIG. 3 is a cutaway bottom view of the device of FIG. 2.

Referring also to FIG. 3, the paper retainer 1 includes a single wire that is bent back upon itself so as to form a bulb-shaped protrusion la at its center point. Paper retainer 1 may be formed, for example, from a metal or plastic wire. The portions of the wire from protrusion 1*a* to its ends form elastically deformable, symmetrical legs 1*b*. Lower end portions 1*c* act as the axis of rotation for the paper retainer, as will be explained below. The lower end portions 1*c* are formed by bending the ends of legs 1*b* at an angle slightly larger than a right angle.

When paper retainer 1 is formed by bending a wire as described above, it can assume either of two states. In one state (illustrated by the solid lines in FIG. 3), virtually the entire paper retainer is enclosed within chamber 8 of case 2, with only protrusion 1*a* exposed. Chamber 8 is positioned between the bottom 6 of case 2 and a fixed partition 7 that runs parallel to the bottom 6 and provides a sufficient space (somewhat wider than the diameter of the wire) for the paper retainer 1.

Figure 5:
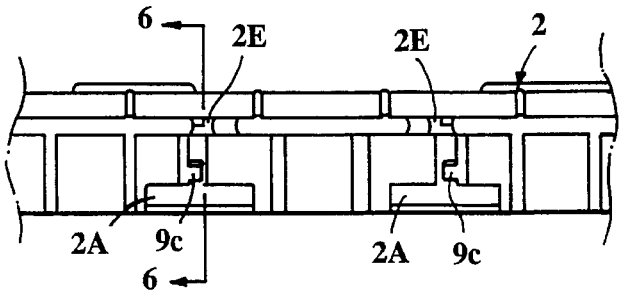
FIG. 5 is a front view portion of the case illustrated in FIG. 4.

In the other state (illustrated by the solid lines in FIGS. 1 and 2 and the broken lines in FIG. 3), virtually the entire paper retainer 1 protrudes from the case 2 through oblong openings 2A (see FIG. 5) on the front of the case 2, leaving only lower end portions 1*c* inside the chamber 8. The paper retainer 1 possesses sufficient elastic force to return it to the enclosed state, in which it is positioned within case 8.

When the paper retainer 1 is enclosed within the chamber 8, hook-shaped pawls 2B (FIG. 3) positioned between openings 2A engage with indentations 1*d* on protrusion 1*a* to lock the paper retainer 1 in place.

As the paper retainer 1 is drawn out of the case 2, lower end portions 1*c* of the paper retainer 1 contact guide ribs 2C located on the outer sides of the openings 2A. Guide ribs 2C guide further bending of paper retainer 1. When paper retainer 1 has reached its maximum extension, as shown by the broken lines in FIG. 3, ribs 2C cause the lower end portions 1*c* to assume a position in which they are collinear.

In the front of the case 2, at the end of the path along which the paper is fed (indicated by arrow X in FIG. 2), there is a slight declivity 2D. When a sheet of paper P has been fed through paper outlet 16 and is completely removed from device 3, it is supported by declivity 2D as it leans on the paper retainer 1. As illustrated in FIGS. 1 and 4–6, two cutout segments 2E in declivity 2D accommodate paper retainer 1. In each cutout segment 2E there are three grooves, 9*a*, 9*b* and 9*c*.

Referring to FIGS. 2 and 3, when the paper retainer 1 is fully extended, as shown in FIG. 2 and by the broken lines in FIG. 3, lower end portions 1*c*, now held collinear by the ribs 2C, rotate on axis O (FIG. 2). Grooves 9*a*, 9*b* and 9*c* immobilize paper retainer 1 when its legs 1*b* elastically engage with them. The paper can be held at three angles with respect to the surface along which it is fed. These are indicated in FIG. 2 by solid lines, dotted lines and broken lines. Locking mechanism 9 allows the user to select, by choosing grooves 9*a*, 9*b* or 9*c*, the angle at which the paper will be held when paper retainer 1 is fully extended.

When the device 3 is not in use, paper retainer 1 is enclosed within chamber 8 in case 2, with legs 1*b* widely separated, as shown by the solid lines in FIG. 3. At this time, indentations 1*d* on protrusion 1*a* of retainer 1 engage with the hook-shaped pawls 2B to lock retainer 1 into the case 2.

When a user wants to use the paper retainer, the user disengages protrusion 1*a* and pulls it slightly forward. Once protrusion 1*a* is released from the pawls 2B, the elasticity of paper retainer 1 cause it to bend and be drawn forward through oblong openings 2A on the front of case 2, as shown by the dotted lines and broken lines in FIG. 3. As paper retainer 1 is being drawn out, its lower end portions 1*c* come in contact with guide ribs 2C, which thereafter guide the travel of lower end portions 1*c*. When the paper retainer 1 has reached its maximum extension, as shown by the broken lines in FIG. 3, the lower end portions 1*c* are forced to assume a collinear orientation.

When the paper retainer 1 has attained its maximum extension, collinear end portions 1*c* define the axis O on which paper retainer 1 rotates. The user selects for the paper retainer 1 one of three angles with respect to the surface along which the paper is fed, which are shown in FIG. 2 by solid, dotted and broken lines. The lower portions of legs 11*b* engage elastically with one set of grooves 9*a*, 9*b* or 9*c*. In this way paper retainer 1 is immobilized at the desired angle. When sheets of paper P are fed out, one by one, through outlet 16 and are completely free of device 3, their lower edges are supported by declivity 2D as they lean against the paper retainer 1.

To store the retainer after use, the user grasps legs 1*b* of paper retainer 1 and releases them from the grooves 9*a*, 9*b* or 9*c*. The user then rotates base segments 1*c* on axis O until paper retainer 1 reaches a position that is aligned with chamber 8. Thereafter, when the user releases paper retainer 1, the elasticity thereof causes it to return to its original state, as shown by the solid lines in FIG. 3. In this state, the paper retainer 1 does not protrude from case 2, and instead is entirely enclosed within it.

Figure 7:
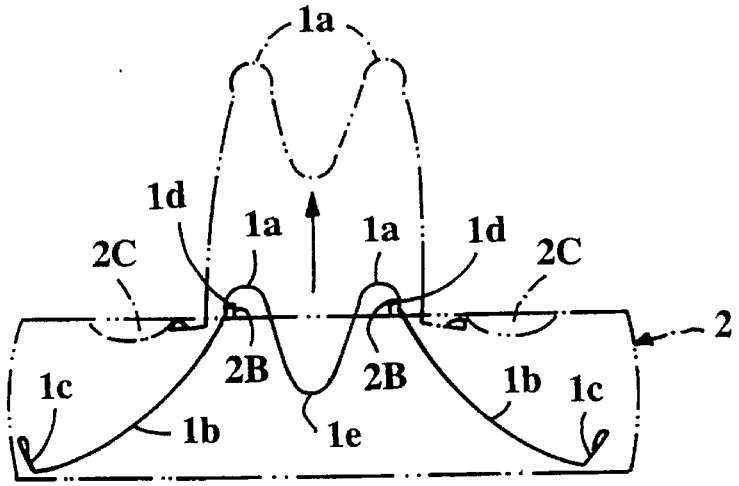
FIGS. 7–9 are top views of other embodiments of the invention.

In the embodiment illustrated in FIG. 3, paper retainer 1 has a single protrusion 1*a* on its outer end. As illustrated in FIG. 7, paper retainer 1 may also have two protrusions 1*a* joined by a U-shaped bend 1*e*. This arrangement provides a wider extended retainer, and may therefore provide greater side-to-side stability for the paper.

Figure 8:
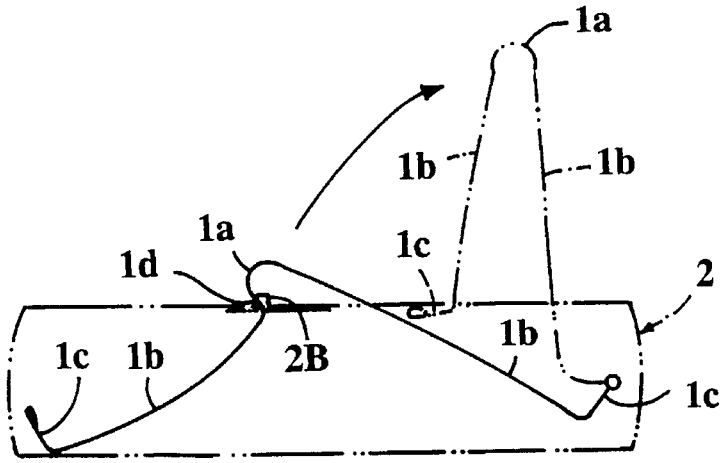

Nor is it necessary for paper retainer 1 to follow a linear path in moving from its storage state to its use state (as illustrated in FIG. 3). For example, as illustrated in FIG. 8, the state of the paper retainer may also be changed by rotating a single leg 1*b* with respect to a single base portion 1*c*.

Figure 9:
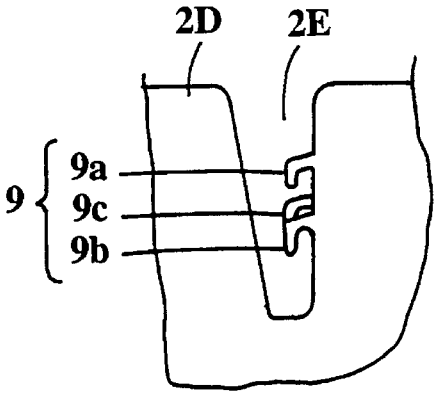
Figure 10:
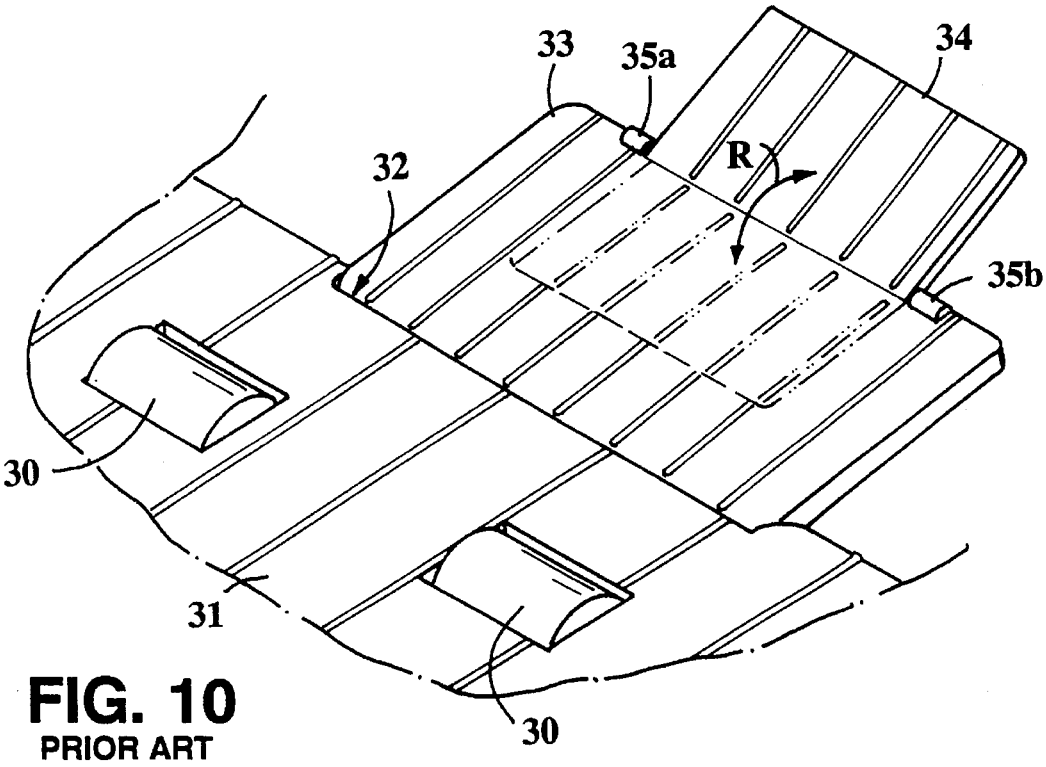
FIG. 10 PRIOR ART
FIGS. 10 and 11 are perspective views of paper retainers of the prior art.
Figure 11:
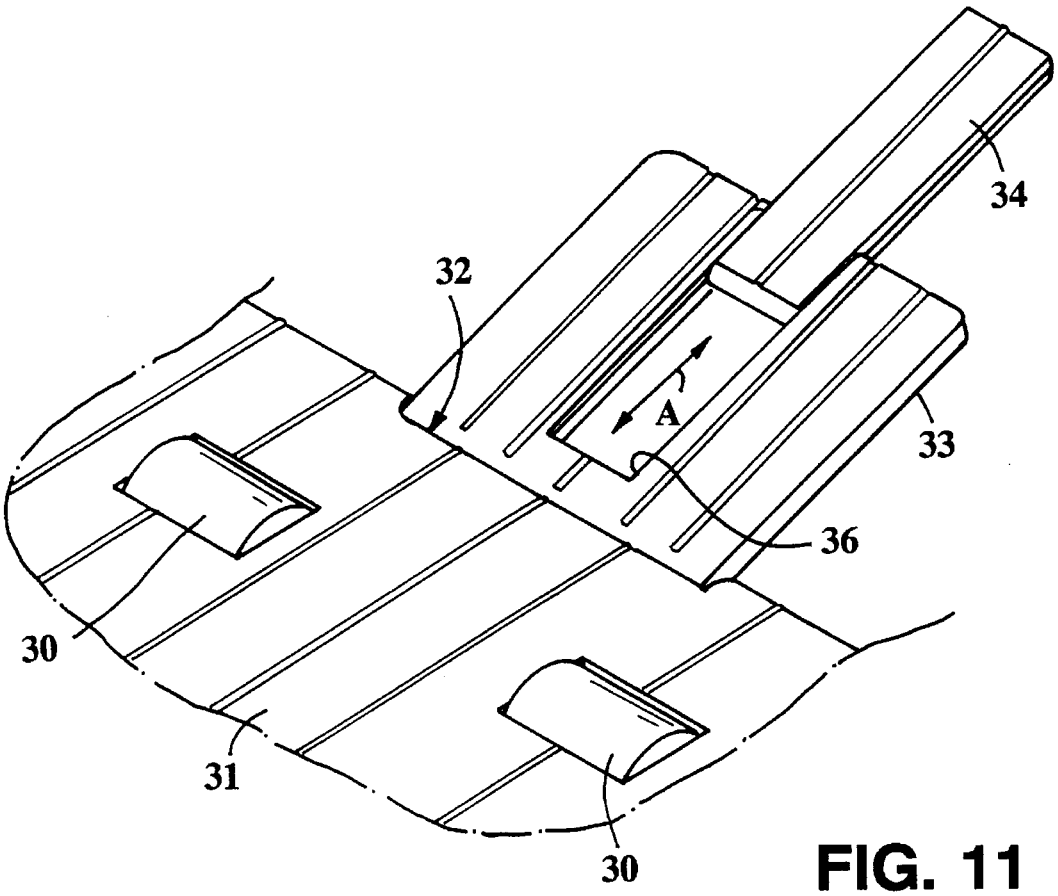
FIG. 11 PRIOR ART

In addition, as illustrated in FIG. 9, hooks 9*a*–9*c* may be substituted for the grooves 9*a*–9*c* of immobilizing mechanism 9. In this case, paper retainer 1 will be held at the desired angle even more securely. Similarly, three sets of grooves or hooks are not required. For example, the system could include only a single set of grooves or hooks.

The grooves or hooks described above for holding paper retainer 1 in position are the simplest and most effective design possible, from the standpoints of both structure and operation. However, the retainer may also be held in place by bolts or any other effective means.

As was discussed above, this invention provides a single paper retainer formed by bending a wire so that it is elastically deformable. In comparison to paper retainers of the prior art, this retainer has a significantly lower production cost due to its lower part count and simpler production process. Furthermore, the paper retainer of the invention can extend from or retract into the case using the force of its own elasticity. This permits extension of the retainer until it is as long as the paper it is to hold, and also permits the paper retainer to handle paper of various lengths. Little space is required for storage of the paper retainer, and the fact that the retainer can be stored compactly allows the size of the device in which it is installed to be reduced. Because the paper retainer has sufficient elastic force to return it to the case, it will automatically retract into the case as soon as it is released from its extended state. Thus, operation of the paper retainer is extremely simple.

When a component capable of elastic engagement is used as the locking mechanism to hold the paper retainer in its extended position, the entire configuration of the device is quite simple, and the operation required to extend or release the retainer is easy to perform.

When locking mechanism can be used to set the retainer at one of a number of angles, as described herein, the paper retainer is able to hold the paper securely regardless of the number of sheets or their thickness. The configuration of the component used to adjust the angle and the operation required to adjust it are both extremely simple.

What is claimed is:

1. A paper retainer assembly for attachment to a feed-in mechanism at a paper inlet or a feed-out mechanism at a paper outlet, comprising:

a flexible, linear paper retainer operable to be extended to an extended position for use and retracted to a retracted position when not in use;

a locking mechanism operable to maintain said paper retainer in the extended position; and a chamber for storage of said paper retainer when said paper retainer is in the retracted position;

wherein said paper retainer is elastically deformable so as to possess sufficient elastic force to cause said paper retainer to retract into said chamber upon release of said locking mechanism.

2. The paper retainer assembly of claim 1, wherein said locking mechanism is operable to maintain said paper retainer at a fixed, predetermined angle relative to the paper inlet or paper outlet when said paper retainer is in the extended position.

3. The paper retainer assembly of claim 1, wherein said paper retainer comprises a wire.

4. The paper retainer assembly of claim 3, wherein said paper retainer comprises a metal wire.

5. The paper retainer assembly of claim 3, wherein said paper retainer comprises a plastic wire.

6. The paper retainer assembly of claim 3, wherein, when said paper retainer is in the extended position, said paper retainer freely rotates about an axis formed by two collinear lower end portions of said wire.

7. The paper retainer assembly of claim 3, wherein said paper retainer is moved between the extended position and the retracted position by rotating the paper retainer about an axis at an end of the paper retainer and perpendicular to a plane defined by the paper retainer.

8. The paper retainer assembly of claim 3, wherein said locking mechanism comprises a groove operable to engage elastically with said wire when said wire is in the extended position.

9. The paper retainer assembly of claim 3, wherein said locking mechanism comprises a hook operable to engage elastically with said wire when said wire is in the extended position.

10. The paper retainer assembly of claim 1, further comprising a case having a chamber for storage of said paper retainer when said paper retainer is in the retracted position and to which said paper retainer is attached when said paper retainer is in the extended position.

11. The paper retainer assembly of claim 10, wherein said locking mechanism comprises a groove on an edge of said case and operable to engage elastically with said paper retainer when said paper retainer is in the extended position.

12. The paper retainer assembly of claim 11, wherein said locking mechanism comprises a plurality of grooves on the edge of said case, wherein each of said grooves is operable to maintain the paper retainer at a different, fixed, predetermined angle relative to the paper inlet or paper outlet when said paper retainer is in the extended position.

13. A paper retainer assembly for attachment to a feed-in mechanism at a paper inlet or a feed-out mechanism at a paper outlet, comprising:

a case, a flexible, linear paper retainer operable to be extended to a position extended from said case for use and retracted to a retracted position in said case when not in use; and a locking mechanism on said case and operable to maintain said paper retainer in the extended position;

wherein said paper retainer is elastically deformable so as to possess sufficient elastic force to cause said paper retainer to retract into said case upon release of said locking mechanism.

14. A paper retainer assembly for attachment to a feed-in mechanism at a paper inlet or a feed-out mechanism at a paper outlet, comprising:

a flexible, linear wire paper retainer operable to be extended to an extended position for use and retracted to a retracted position when not in use; and a locking mechanism operable to maintain said paper retainer in the extended position;

wherein said paper retainer is moved between the extended position and the retracted position by rotating the paper retainer about an axis at an end of the paper retainer and perpendicular to a plane defined by the paper retainer.

15. The paper retainer assembly of claim 14, wherein said locking mechanism is operable to maintain said paper retainer at a fixed, predetermined angle relative to the paper inlet or paper outlet when said paper retainer is in the extended position.

16. The paper retainer assembly of claim 14, further comprising a chamber for storage of said paper retainer when said paper retainer is in the retracted position.

17. The paper retainer assembly of claim 14, wherein said paper retainer comprises a metal wire.

18. The paper retainer assembly of claim 14, wherein said paper retainer comprises a plastic wire.

19. The paper retainer assembly of claim 14, wherein, when said paper retainer is in the extended position, said paper retainer freely rotates about an axis formed by two collinear lower end portions of said wire.

20. The paper retainer assembly of claim 14, wherein said locking mechanism comprises a groove operable to engage elastically with said wire when said wire is in the extended position.

21. The paper retainer assembly of claim 14, wherein said locking mechanism comprises a hook operable to engage elastically with said wire when said wire is in the extended position.

22. The paper retainer assembly of claim 14, further comprising a case having a chamber for storage of said paper retainer when said paper retainer is in the retracted position and to which said paper retainer is attached when said paper retainer is in the extended position.

23. The paper retainer assembly of claim 22, wherein said locking mechanism comprises a groove on an edge of said case and operable to engage elastically with said paper retainer when said paper retainer is in the extended position.

24. The paper retainer assembly of claim 23, wherein said locking mechanism comprises a plurality of grooves on the edge of said case, wherein each of said grooves is operable to maintain the paper retainer at a different, fixed, predetermined angle relative to the paper inlet or paper outlet when said paper retainer is in the extended position.

25. A paper retainer assembly for attachment to a feed-in mechanism at a paper inlet or a feed-out mechanism at a paper outlet, comprising:

a case, a flexible, linear wire paper retainer operable to be extended to a position extended from said case for use and retracted to a retracted position in said case when not in use; and a locking mechanism on said case and operable to maintain said paper retainer in the extended position;

wherein said paper retainer is moved between the extended position and the retracted position by rotating the paper retainer about an axis at an end of the paper retainer and perpendicular to a plane defined by the paper retainer.

* * * * *